US005789143A

United States Patent [19]

Burgmaier et al.

[11] Patent Number: 5,789,143

[45] Date of Patent: Aug. 4, 1998

[54] THIOETHERS IN PHOTOGRAPHIC ELEMENTS

[75] Inventors: George J. Burgmaier, Pittsford; David A. Dickinson, Brockport; Robert A. Guistina, Rochester, all of N.Y.

[73] Assignee: Eastman Kodak Company, Rochester, N.Y.

[21] Appl. No.: 846,944

[22] Filed: Apr. 30, 1997

[51] Int. Cl.[6] ..... G03C 1/043; G03C 1/295

[52] U.S. Cl. ..... 430/444; 430/448; 430/469; 430/487; 430/603; 430/611

[58] Field of Search ..... 430/444, 448, 430/469, 487, 603, 611

[56] References Cited

U.S. PATENT DOCUMENTS

| | | | |
|---|---|---|---|
| 3,201,242 | 8/1965 | Schwan et al. | 430/487 |
| 3,813,247 | 5/1974 | Minsk et al. | 430/627 |
| 4,013,471 | 3/1977 | Pollet et al. | 430/377 |
| 4,072,523 | 2/1978 | Pollet et al. | 430/569 |
| 4,292,400 | 9/1981 | Pollet et al. | 430/487 |
| 4,665,017 | 5/1987 | Mifune et al. | 430/569 |
| 5,041,367 | 8/1991 | Sniadoch | 430/603 |
| 5,691,130 | 11/1997 | Buitano et al. | 430/611 |

FOREIGN PATENT DOCUMENTS

| | | | |
|---|---|---|---|
| 1-121846 | 5/1989 | Japan | G03C 1/02 |

*Primary Examiner*—Mark F. Huff
*Attorney, Agent, or Firm*—Sarah Meeks Roberts

[57] ABSTRACT

This invention relates to a silver halide color photographic element comprising a support, a silver halide emulsion and poly(thioether)s wherein greater than 50 percent of the poly(thioether)s have acidic functional end groups with an aqueous pKa≦10, or end groups which will react to form acidic functional end groups with an aqueous pKa≦10 during development, on both termini and wherein the poly (thioether)s have a molecular weight greater than 800.

14 Claims, No Drawings

THIOETHERS IN PHOTOGRAPHIC ELEMENTS

FIELD OF THE INVENTION

This invention relates to the use of development accelerators in silver halide photographic elements. More specifically it relates to the use of poly(thioether)s as the accelerators.

BACKGROUND OF THE INVENTION

It is often desirable to obtain more rapid or accelerated photographic development during the processing of a silver halide photographic material. More rapid or accelerated photographic development is observed when the same exposure and process time provides increased photographic speed or higher Dmax for a photographic element. It is important that the increased photographic development not be accompanied by an undesirable increase in the amount of fog.

In order to achieve more rapid photographic development, two approaches are possible. The first approach involves a change in the process such as an increase in the temperature of the process or a change in the composition of the developer. This approach is not often practical, especially when a photographic element has more than one light sensitive layer, and each layer responds differently to process changes. The second approach is to incorporate an additive which increases the rate of photographic development into a light-sensitive layer or an adjacent non-light-sensitive layer.

A number of additives, sometimes called development accelerators, have been described which, when added to a photographic element, will increase the rate of photographic development. Some of these additives are poly(alkylene oxide)s as described in Y. Inaba and A. Kumai: Photo. Sci. Eng.,17, 499(1973); pyrazolidone/cyclodextran inclusion complexes as described in GB 2,261,740; and substituted diaminedithio-containing materials as described in U.S. Pat. No. 5,192,655.

Various thioethers, particularly polymers, have been described as development accelerators in, for example, U.S. Pat. Nos. 3,046,132; 3,813,247; 3,046,134; 3,046,129; 3,057,724; and 3,165,552. The manufacture of these materials for use as development accelerators has a problem in that some of the polymers synthesized have low photographic activity. The use of polymeric thioethers of variable and sometimes low photographic activity is unacceptable for the manufacture of photographic sensitized goods where uniform performance is desired.

Other thioethers are described for use as development accelerators in U.S. Pat. No. 4,013,471 and 4,072,523. Polymers with pendant thioether groups are described for use in a developer solution in U.S. Pat. No. 4,038,075. However, none of these patents describe thioethers which consistently show the high activity and uniformity of those of the current invention.

SUMMARY OF THE INVENTION

This invention provides a silver halide color photographic element comprising a support, a silver halide emulsion and poly(thioether)s wherein greater than 50 percent of the poly(thioether)s have acidic functional end groups with an aqueous pKa≦10, or end groups which will react to form acidic functional end groups with an aqueous pKa≦10 during development, on both termini, and wherein the poly(thioether)s have a molecular weight greater than 800. This invention also provides a silver halide color photographic element comprising a support, a silver halide emulsion and poly(thioether)s wherein greater than 50 percent of the poly(thioether)s are represented by Formula I $$A-(L_i-X_i)_n-L-A' \qquad \text{I}$$

wherein

A and A' are independently acidic functional groups;

L and $L_i$ are independently divalent organic linking groups;

$X_i$ is independently a non-metallic heteroatom, with the proviso that at least one Xi must be a sulfur; and n is one to 300; and wherein the poly(thioether)s have a molecular weight greater than 800.

The poly(thioether)s of this invention can provide a significant increase in development yield and speed, and a change in Dmax in a photographic element. Further, the poly(thioether)s of this invention provide more uniform development acceleration.

DETAILED DESCRIPTION

While thioethers and poly(thioether)s have been described as development accelerators, the inventors herein have discovered that the photographic activity of these materials can be dramatically and unexpectedly increased by forming derivatives of these materials such that the end groups are converted to acidic functional groups or groups which can react to form acidic functional groups under photographic development conditions. Examples of groups which may react are esters, amides and isocyanates all of which may hydrolyze during color development. Other groups may react via different mechanisms. The development step may be either with a color developer or, in the case of a color reversal process, it may take place with a black and white developer.

The thioether polymers known in the art are often prepared by combining diols with dicarboxilic acids at high temperatures in condensation reactions, and removing the water which is formed under vacuum. Such polymers commonly have a statistical distribution of alcohol and carboxylic acid end groups. The total end group population of alcohol groups and population of carboxylic acid end groups will usually be equal to each other if the molar amounts of starting materials are also equal.

In this invention, however, greater than 50 percent of the poly(thioether)s utilized in the photographic element have acidic functional end groups with an aqueous pKa≦10, or end groups which will react to form acidic functional end groups with an aqueous pKa≦10 during color development, on both termini. Preferably greater than 95 percent of the poly(thioether)s have such groups on both termini, more preferably greater than 98 percent have such groups on both termini and most preferably substantially all of the poly (thioether)s such groups on both termini. Acidic functional groups are preferred over groups which can react to form into acidic functional groups.

Suitable poly(thioether)s have a molecular weight greater than 800. Preferably the poly(thioether)s have a molecular weight ranging between 800 and 16000 AMU, more preferably between 800 and 10000 AMU and most preferably between 1000 and 7000 AMU.

Polymers ending with carboxylic acid groups are particularly potent development accelerators. Polymers ending with other acidic functional groups are also possible. Such end groups could be (but are not restricted to) sulfonate groups or phosphoric acids groups.

In one embodiment of this invention greater than 50 percent, more preferably greater than 95 percent, of the poly(thioether)s contained in the photographic element are represented by Formula I.

$$A-(L_i-X_i)_n-L-A' \qquad I$$

A and A' are independently acidic functional groups or a salts thereof with an aqueous pKa≦10. Useful examples of A and A' include, but are not limited to, carboxylic acids, carboxylate salts, sulfonic acids, sulfinic acids, cyanamides, sulfonamides, hydroxamic acids, thiols, thiolates, and the like.

L and Li are independently divalent organic linking groups, preferably of about 1–35 non-hydrogen atoms, and more preferably of about 1–20 non-hydrogen atoms. The linking group may be substituted or unsubstituted. Preferred linking groups include alkylene, alkenyl, arylene, aralkylene or heteroarylene groups. Examples of suitable linking groups include

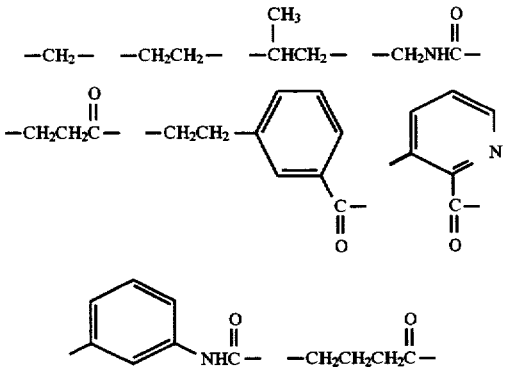

and the like.

Xi is independently a non-metallic heteroatom, either substituted or unsubstituted. Useful examples include —O—, —S—, —SO—, —$SO_2$—, —$NR_1$—wherein $R_1$, is an organic substituent of about 1–20 non-hydrogen atoms. $R_1$ may be, for example, a substituted or unsubstituted alkyl, alkenyl, aryl, aralkyl or heteroaryl, acyl, sulfonyl, or ureido group. At least one of the Xi groups must be sulfur.

Examples of (Li-Xi) which can be used in the present invention include the materials below.

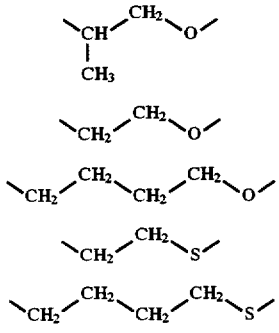

The (Li-Xi) groups may be combined to form repetitive combinations of the same (Li-Xi) groups or may be combined to form linear combinations of different (Li-Xi) groups. As such, (Li-Xi) may be combined to form block copolymers. Useful examples include block copolymers of ethylene oxide and propylene oxide also known as PLURONIC and R PLURONIC block copolymers shown below.

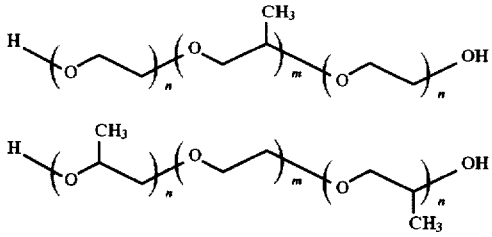

(Li-Xi) may also include random copolymers of ethylene oxide and propylene, and the like. As noted above, at least one Xi must be a sulfur to form a thioether. The acidic functional group should be connected either directly or indirectly through a linking group to the thioether. It is preferred that the acidic functional group be separated from the thioether by a linking group.

Suitable poly(thioether)s of Formula I have a molecular weight greater than 800. Preferably the poly(thioether)s have a molecular weight ranging between 800 and 16000 AMU, more preferably between 800 and 10000 AMU and most preferably between 1000 and 7000 AMU.

These materials can be prepared by modifying an existing polymer such as those described in U.S. Pat. Nos. 3,046,132; 3,813,247; 3,046,134; 3,046,129; 3,057,724; and 3,165,552. This modification procedure, as demonstrated in the examples, is usually a separate process and results in a polymer where all the end groups are acidic functional groups or groups which can be converted into are acidic functional groups under photographic development conditions. One class of materials which are useful for this invention are polyesters whose end groups have been converted into acidic functional groups, as demonstrated in the examples. Typical polyesters can be made by methods well known in the art. They can be made from the reaction of dicarboxylic acids or anhydrides with glycols. Useful examples of dicarboxylic acids or anhydrides are:

| | |
|---|---|
| succinic | suberic |
| glutaric | 4-thiapimelic |
| adipic | 3,6-dithiasuberic |
| azelaic | 3,7-dithiaazelaic |
| sebacic | 3,8-dithiasebacic |
| pimelic | 3-thiaadipic. |

Useful examples of glycols are:

3,11-dithia-7-oxatridecane-1,13-diol
3-thiapentane-1,5-diol
3,6-dithiaoctane-1,8-diol
4,10-dithiatridecane-1,13-diol
4,15-dithiaoctadecane-1,18-diol
7,13-dithianonadecane-1,19-diol
7,13-dithiatetracosane-1,24-diol
4,8-dithiaundecane-2,11-diol
3-thiahexane-1,6-diol
4-thiaheptane-1,7-diol
3-thianonane-1,9-diol.

These glycols may be combined with glycols containing aromatic groups. Examples of such glycols are:

| | |
|---|---|
| 1,4-benzenedimethanol | 2,5-bis(3-hydroxypropyl)butoxybenzene |
| 1,4-benzenedipropanol | 2,5-(dihydroxymethyl)chlorobenzene |

-continued

| | |
|---|---|
| 2,5-toluenedimethanol | 2,2'-(4-methoxybenzylimino)diethanol |
| 2,5-phenetoledipropanol | 3,3'-(4-propylbenzylimino)dipropanol |
| 2,5-ethylbenzenedimethanol | 2,2'-(2-bromobenzylimino)diethanol |
| 2,2'-(benzylimino)diethanol | 4,4'-(3,5-dimethylbenzylimino)dibutanol. |

Another class of thioethers which is useful in our invention is indicated below. Values of n from 4 to 16 are preferred, and from 4 to 7 are most preferred.

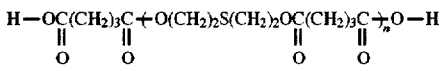

It is understood that n in the above formula may be a single integer representing a single chemical entity or may also be a range of integers representing a blend of chemical entities. The pure compounds and the blends of components both have utility in this invention. When a blend of inventive compounds is used it is understood that the blend may be made by combining the pure compounds synthesized as described in the examples in any proportion or may also result from conventional condensation polymerization synthesis which is well known to those skilled in the art.

It is understood throughout this specification and claims that any reference to a substituent by the identification of a group containing a substitutable hydrogen (e.g., alkyl, amine, aryl, alkoxy, heterocyclic, etc.), unless otherwise specifically described as unsubstituted or as substituted with only certain substituents, shall encompass not only the substituent's unsubstituted form but also its form substituted with any substituents which do not negate the advantages of this invention. Examples of suitable substituents include halogen, such as chlorine, bromine or fluorine; alkyl or aryl groups, including straight, branched or cyclic alkyl groups, such as those containing 1 to 30 carbon atoms, for example methyl, trifluoromethyl, ethyl, t-butyl, phenyl, tetradecylphenyl, 4-t-butylphenyl, 2,4,6-trimethylphenyl and naphthyl; alkoxy groups, such as an alkoxy group containing 1 to 30 carbon atoms, for example methoxy, ethoxy, 2-ethylhexyloxy and tetradecyloxy; aryloxy groups, such as phenoxy, α- or β- naphthyloxy, and 4-tolyloxy; acylamino groups, such as acetamido, benzamido, butyramido, tetradecanamido, α-(2,4-di-t-amylphenoxy)-acetamido, α-(2,4-di-t-amylphenoxy)butyramido, α-(3-pentadecylphenoxy)hexanamido, α-(4-hydroxy-3-t-butylphenoxy)tetradecanamido, 2-oxo-pyrrolidin-1-yl, 2-oxo-5-tetradecylpyrrolin-1-yl, N-methyltetradecanamido, and t-butylcarbonamido; sulfonamido groups, such as methanesulfonamido, benzenesulfonamido, p-toluenesulfonamido, p-dodecylbenzenesulfonamido, N-methyltetradecylsulfonamido, and hexadecanesulfonamido; sulfamoyl groups, such as N-methylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sufamido groups, such as N-methylsulfamido and N-octadecylsulfamido; carbamoyl groups, such as N-methylcarbamoyl, N-octadecylcarbamoyl, N-[4-(2,4-di-t-pentyl-phenoxy)butyl]carbamoyl, N-methyl-N-tetradecylcarbamoyl, and N,N-dioctylcarbamoyl; diacylamino groups, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl groups, such as phenoxycarbonyl and p-dodecyloxphenoxy carbonyl; alkoxycarbonyl groups, such as alkoxycarbonyl groups containing 2 to 30 carbon atoms, for example methoxycarbonyl, tetradecyloxycarbonyl, ethoxycarbonyl, benzyloxcarbonyl, and dodecyloxycarbonyl; alkoxysulfonyl groups, such as alkoxysulfonyl groups containing 1 to 30 carbon atoms, for example methoxysulfonyl, octyloxysulfonyl, tetradecyloxysulfonyl, and 2-ethylhexyloxysulfonyl; aryloxysulfonyl groups, such as phenoxysulfonyl, 2,4-di-t-amylphenoxysulfonyl; alkanesulfonyl groups, such as alkanesulfonyl groups containing 1 to 30 carbon atoms, for example methanesulfonyl, octanesulfonyl, 2-ethylhexanesulfonyl, and hexadecanesulfonyl; arenesulfonyl groups, such as benzenesulfonyl, 4-nonylbenzenesulfonyl, and p-toluenesulfonyl; alkylthio groups, such as alkylthio groups containing 1 to 22 carbon atoms; for example ethylthio, octylthio, benzylthio, tetradecylthio, and 2-(2,4-di-t-amylphenoxy)ethylthio; arylthio groups, such as phenylthio and p-tolylthio; alkoxycarbonylamino, such as ethoxycarbonylamino, benzyloxycarbonylamino, and hexadecyloxycarbonylamino; alkylureido groups, such as N-methylureido, N,N-dimethylureido, N-methyl-N-dodecylureido, N-hexadecylureido, N,N-dioctadecylureido, and N,N-dioctyl-N'-ethyl-ureido; acyloxy groups, such as acetyloxy, benzoyloxy, octadecanoyloxy, p-dodecanamidobenzoyloxy, and cyclohexanecarbonyloxy; nitro groups; cyano groups; carboxy groups or other acid groups and heterocyclic groups including 3- to 15-membered rings with at least one atom selected from nitrogen, oxygen, sulfur, selenium and tellurium such as pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings; where preferably the foregoing organic substituents contain not more than 10 and more preferably not more than 5 carbon atoms. Furthermore, any reference to an alkyl group includes cyclic groups.

The color silver halide photographic element of the invention can have any of the image forming or non-imaging forming layers known in the art. The photographic element is a multilayer, multicolor element and includes both negative and reversal elements. A multicolor element contains dye image-forming units sensitive to each of the three primary regions of the visible light spectrum. Each unit can be comprised of a single emulsion layer, or of multiple emulsion layers spectrally sensitive to the same or substantially the same region of the spectrum. The layers of the element, can be arranged in various orders as known in the art.

In this invention the multicolor photographic element comprises a support having situated thereon, preferably in order from the support, a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler.

Photographic emulsions are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised and maintained for a period of time. The precipitation and spectral and chemical sensitization methods utilized in preparing the emulsions employed in the invention can be those methods known in the art Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. Preferably, the emulsion is sensitized both with gold and a chalcogenide, most preferably gold and sulfur. Examples of sulfur sensitizers include sodium thiosulfate, alkyl or aryl thiourea compounds, or thiourea compounds with nucleophilic substituents as described in U.S. Pat. No. 4,810,626. Examples of gold sensitizers include potassium tetrachloroaurate, potassium dithiocyanato gold (I), trisodium dithiosulfato gold(I), and the gold (I) compounds described in U.S. Pat. Nos. 5,049,484; 5,049,485; 5,252,455; 5,220,030; and 5,391,727. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, bead coating, curtain coating and extrusion coating.

The compounds of this invention may be added to the silver halide emulsion at any time during the preparation of the emulsion, i.e., during precipitation, during or before chemical sensitization or during final melting and co-mixing of the emulsion and additives for coating. More preferably, these compounds are added during final melting and co-mixing of the emulsion and additives for coating.

Useful levels of the poly(thioether)s range from 0.01 to 10.0 millimoles per silver mole. The preferred range is from 0.05 to 1.0 millimoles per silver mole with a more preferred range being from 0.1 to 0.4 millimoles per silver mole.

The compounds may be added to the photographic emulsion using any technique suitable for this purpose. Preferably they are added as a direct dispersion prepared by the standard methods known to those skilled in the art. Combinations of more than one poly(thioether) may be utilized.

The element may contain layers in addition to those described above. Such layers include filter layers, in particularly yellow and magenta filter dye layers, interlayers, overcoat layers, subbing layers, and the like. The photographic elements may also contain a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994(Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

The silver halide emulsion employed in the dye-forming units of the invention can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

The silver halide emulsion can be either monodisperse or polydisperse as precipitated. The grain size distribution of the emulsion can be controlled by silver halide grain separation techniques or by blending silver halide emulsions of differing grain sizes.

The grains may be comprised of any halide combination, including silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. Preferred are iodobromide emulsions with an iodide content of 2 to 12%.

The grains can be contained in cap conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin)—or acid treated gelatin (pigskin gelatin) and gelatin derivatives—e.g., acetylated gelatin, phthalated gelatin—are specifically contemplated. When used, gelatin is preferably at levels of 0.01 to 100 grams per total silver mole. Also contemplated are dispersing mediums comprised of synthetic colloids.

Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film).

In a typical construction, a reversal film does not have any masking couplers. Furthermore, reversal films have a gamma generally between 1.5 and 2.0, a gamma which is much higher than the gamma for typical negative materials.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3&4 | I, II, III, IX A&B | hardeners, coating aids, addenda, etc. |
| 1 | III, IV | Chemical sensitization and |
| 2 | III, IV | spectral sensitization/ |
| 3&4 | IV, V | desensitization |
| 1 | V | UV dyes, optical |
| 2 | V | brighteners, luminescent |
| 3&4 | VI | dyes |
| 1 | VI | Antifoggants and stabilizers |
| 2 | VI | |
| 3&4 | VII | |
| 1 | VIII | Absorbing and scattering |
| 2 | VIII, XIII, XVI | materials; Antistatic layers; matting agents |
| 3&4 | VIII, IX C &D | |
| 1 | VII | Image-couplers and image- |
| 2 | VII | modifying couplers; Wash- |
| 3&4 | X | out couplers; Dye stabilizers and hue modifiers |
| 1 | XVII | Supports |
| 2 | XVII | |
| 3&4 | XV | |
| 3&4 | XI | Specific layer arrangements |
| 3&4 | XII, XIII | Negative working emulsions; Direct positive emulsions |
| 2 | XVIII | Exposure |
| 3&4 | XVI | |
| 1 | XIX, XX | Chemical processing; |
| 2 | XIX, XX, XXII | Developing agents |
| 3&4 | XVIII, XIX, XX | |
| 3&4 | XIV | Scanning and digital processing procedures |

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-napthalates)), paper and polymer coated paper. Such supports are described in further detail in *Research Disclosure* 3, Section XV.

The photographic elements may also contain additional materials that accelerate or otherwise modify the processing steps of bleaching or fixing to improve the quality of the image. Bleach accelerators described in European Patent Applications No. 193,389 and 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol and/or yellow and/or magenta filter dyes, either as oil-in-water dispersions, latex dispersions or as solid particle dispersions. Additionally, they may be used with "smearing" couplers (e.g. as described in U.S. Pat. No. 4,366,237; European Patent Application 96,570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). DIR compounds are disclosed, for example, in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. DIRs that have particular application in color reversal elements are disclosed in U.S. Pat. Nos. 5,399,465; 5,380,633; 5,399,466; and 5,310,642.

It is also contemplated that the concepts of the present invention may be employed to obtain reflection color prints. The emulsions and materials to form elements of the present invention, may be coated on pH adjusted support as described in U.S. Pat. No. 4,917,994; with epoxy solvents (European Patent Application 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide grains to be used in the invention may be prepared according to methods known in the art, such as those described in *Research Disclosure* 3 and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure* 3 and the references cited therein.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure* 3. Examples of dyes include dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, stryryls, merostyryls, and streptocyanines. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating.

Photographic elements of the present invention can be imagewise exposed using any of the known techniques, including those described in *Research Disclosure* 3. This typically involves exposure to light in the visible region of the spectrum, and typically such exposure is of a live image through a lens. However, the photographic elements of the present invention may be exposed in a film writer as described above. Exposure in a film writer is an exposure to a stored image (such as a computer stored image) by means of light emitting devices (such as light controlled by light valves, CRT and the like).

Standard processing for negative or reversal elements may be utilized, including standard Kodak C-41 and Kodak E-6 processing. The color reversal process requires first treating the element with a black and white developer, followed by fogging non-exposed grains using chemical or light fogging, followed by treatment with a color developer.

Preferred non-chromogenic developers (that is, black and white developers) are hydroquinones (such as hydroquinone sulphonate).

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like. Further details of bleach and fixing baths can be found in *Research Disclosure* 3.

The photographic elements can be incorporated into exposure structures intended for repeated use or exposure structures intended for limited use, variously referred to as single use cameras, lens with film, or photosensitive material package units. However, the color reversal elements of the present invention can also be used by exposing in an electronic film writer (such film writers typically expose the film by laser, laser diode, or some other controlled light source).

The practice of the invention is described in detail below with reference to specific illustrative examples, but the invention is not to be construed as being limited thereto.

EXAMPLES

Preparative Examples

Compound 1

To 3 L of tetrahydrofuran was added 223 g of bis(2-hydroxyethyl)sulfide, 484 g glutaric anhydride (90% assay), and 700 mL triethylamine. The mixture was heated at reflux for 18 hr under nitrogen at which time the solvent was removed using the rotovap. The residue was diluted with 1 L of cold water which was immediately poured onto ice which contained 450 mL of concentrated HCl. The solid which formed was collected, and then purified by crystallization from methanol/water, obtaining 558 g of a white solid, mp 84.5°–86° C.

Compound 2

To a mixture of 105 g 1 and 900 mL dry methylene chloride was added 66 mL oxalyl chloride. The suspension was allowed to stir at room temperature for 4 hr during which time solution occurred. The solvent was removed on the rotary evaporator and the residue dissolved in 525 mL dry tetrahydrofuran. This solution was added dropwise at room temperature over a 4 hr period to a solution of 1833 g bis (2-hydroxyethyl)sulfide in 750 mL dry tetrahydrofuran containing 113 mL triethylamine. Upon complete addition, the solution was allowed to stand at room temperature overnight. The solvent was then removed on the rotary evaporator and the residue taken up in 500 mL methylene chloride and 4 L water containing 40 mL concentrated HCl. After separating the layers, the aqueous layer was washed with two 500 mL portions of methylene chloride. The combined organic layers were washed with 2 L of distilled water and then dried over anhydrous magnesium sulfate. After removing the solvent, the residue was crystallized from ethanol at ice temperature, obtaining 160 g white solid, mp 50°–55° C. The product was analyzed by size exclusion chromatography, and found to be >95% one component. The proton NMR was consistent with the desired material.

Compounds 3 through 7

The diacid 3 was prepared from 2 in a manner similar to the preparation of 1. The dialcohol 4 was prepared from 3 in a manner similar to the preparation of 2.5 was then prepared likewise from 4,6 likewise from 5, and 7 was prepared likewise from 6. Each product was analyzed by size exclusion chromatography, and found to be >95% one component of the proper molecular weight. An analogous series could be prepared using glutaryl dichloride and excess bis(2-hydroxyethyl)sulfide in the first step of the sequence.

Compound 8

A mixture of 115 g glutaric anhydride and 126 g bis(2-hydroxyethyl)sulfide was heated to 165° C. and held at that temperature for 30 min. Vacuum of 30 mm Hg was applied for 5.5 hr, maintaining the temperature at 165° C., collecting the water condensate which was formed. The residue was cooled to 45° C. and then suspended in 1 L methanol preheated to 55° C . The suspension was cooled with rapid stirring to 5° C., and the solid which formed was recovered by filtration, washing with cold methanol. End group analysis of the polymer by proton NMR and titration indicated about equal distribution of alcohol and acid ends: acid ends: 0.51 meq/g; alcohol ends: 0.50 meq/g. Size exclusion chromatography gave polystyrene equivalent number and weight average molecular weight of 2290 and 3520, respectively. The molecular weight of 8 can be modified by changing either the reaction time or temperature or both.

Compound 9

To a solution of 3 g of the polyester Compound 8 in 10 mL of distilled tetrahydrofuran was bubbled a nitrogen gas stream containing freshly-generated diazomethane. The nitrogen/diazomethane gas stream was applied to the substrate solution until a distinct yellow color persisted in the solution indicating that an excess of diazomethane existed. The yellow solution was allowed to stand at room conditions in a loosely-capped vial for 72 hours to ensure completion of the esterification reaction. The solvent was removed under a vigorous nitrogen stream until a dark oil resulted. The oil was vacuum-dried at 50° C. for 24 hours. The oil was then slurried in 20 mL methanol at room temperature for about 5 minutes and then cooled to 10° C. with constant mechanical stirring resulting in crystallization of the product. The off-white solid was collected by vacuum filtration, washed with cold methanol and vacuum-dried at 25° C. for 24 hours. The yield was 2.7 g, 90% of expected.

Analysis: <0.005 meq/g total acid end groups by titration (typical examples of 8 contain from 0.1 to 1.0 meq/g acid ends). NMR ($CDCl_3$) singlet at 4 ppm from methyl ester end groups (this peak is absent in 8).

Compound 10

To a solution of 3 g of the polyester Compound 8 in 10 mL of distilled tetrahydrofuran was added with gentle stirring 0.22 g of glutaric anhydride and 0.20 g of triethylamine. The reaction mixture was stirred at 70° C. for 5 hours. After cooling, the solvent was stripped under a vigorous nitrogen stream to yield a thick, dark, oil. To this oil was added 10 mL of 10° C. methanol containing 2 mL of aqueous 1N HCl with good mechanical stirring. The mixture was placed in an ice bath and stirred until crystallization took place. The off-white product was collected on a vacuum funnel, washed with cold methanol and vacuum-dried at 25° C. for 24 hours. The yield was 2.9 g, 99.8% of theory.

Analysis: 0.65 meq/g acid end groups by titration, 93% of the expected level based on the quantitative conversion of alcohol end groups in 8 to acid end groups. NMR ($CDCl_3$) peak due to OH at 3.5 ppm is absent in product.

Compound 12

To a solution of 144 g of NaOH in 1.5 L of water at 55° C., under a nitrogen atmosphere, was added 140 g 1,8-dimercapto-3,6-dioxaoctane followed by a solution of 299 g 6-bromohexanoic acid in 300 mL water. A slight exotherm to about 70° C. occurs. The solution was then stirred at ambient temperature overnight, and then on the steampot for 3 hr. Upon cooling to room temperature, the solution was added with rapid stirring to a mixture of 180 mL conc. HCL in ice/water. The solid which formed was collected, washed well with cold water, and air dried to yield 316 g of white material. It was crystallized by dissolving in 2 L boiling acetonitrile, filtering hot through Celite to remove some sodium chloride, and cooling to ice temperature, collecting 270.5 g white solid, mp 70°–3° C. The proton NMR spectrum was consistent for 10,13-dioxa-7,16-dithiadocosane-1,22-dioic acid. To 100 mL dry methylene chloride (3 Å molecular sieves) was added 12.31 g 10,13-dioxa-7,16-dithiadocosane-1,22-dioic acid and 6.6 mL oxalyl chloride. The suspension was stirred at room temperature for 4 hr and then concentrated to an oil. The oil was dissolved in 450 mL dry tetrahydrofuran (3 Å molecular sieves) and added dropwise to a solution of 1200 g of PEG 200 and 25.2 mL triethylamine in 900 mL dry tetrahydrofuran. The dropwise addition was carried out at room temperature and was complete in 100 min; the reaction mixture was allowed to remain at room temperature for 2.5 days. The solvent was removed and the residue was diluted with water containing 9 mL concentrated HCL. The suspension was extracted five times with 375 mL portions of methylene chloride. The combined methylene chloride fractions were washed twice with water to remove traces of PEG 200, dried over anhydrous magnesium sulfate, and concentrated to yield 34 g of a clear oil. An infrared spectrum of the oil indicated a broad OH peak at 3482 $cm^{-1}$ and a carbonyl absorption at 1735 $cm^{-1}$. Size exclusion chromatography gave polystyrene equivalent number and weight average molecular weights of 1070 and 1130, respectively.

To 100 mL dry tetrahydrofuran (3 Å molecular sieves) was added 11.34 g of the oil from above, followed by 3.51 g glutaric anhydride and 4.6 mL triethylamine. The mixture was heated at reflux for 13 hr at which time the solvent was removed and the residue diluted with water containing 3 mL conc. HCL. The suspension was extracted four times with methylene chloride and the combined organic phases were dried over anhydrous magnesium sulfate, and then concentrated to yield 16.32 g of an oil. An infrared spectrum of the oil indicated a broad carboxylic acid OH peak and a carbonyl absorption at 1734 $cm^{-1}$. Combustion analysis: Calculated for $C_{46}H_{82}O_{21}S_2$: C, 53.37; H, 7.98; S, 6.37. Found: C, 53.68; H, 8.15; S, 6.37. Size exclusion chromatography gave polystyrene equivalent number and weight average molecular weights of 1330 and 1430, respectively.

Compound 23

To 200 mL dry pyridine (3 Å molecular sieves) was added 75 g PEG 1500 and the solution was cooled to 5° C. To this solution was added all at once 20.97 g p-toluenesulfonyl chloride, and the flask was stored in the freezer for 4 days. The reaction mixture was poured into 375 mL cold, acidic water, and the bistosylate was isolated by extraction with methylene chloride. After drying over anhydrous magnesium sulfate, the methylene chloride was removed to give 57.64 g of a clear oil. The infrared spectrum showed the absence of a hydroxyl group.

To 138 mL of 0.5M sodium methoxide in methanol containing 4.84 g of 2-mercaptoethanol, all under nitrogen, was added a solution of 56.61 g of the bistosylate prepared above in 2250 mL methanol. The solution was heated at reflux for 40 hr, cooled to room temperature, and diluted with 100 mL water. Most of the methanol was removed and 100 mL of a 5% salt solution and methylene chloride was added. After the layers were separated, the aqueous layer was extracted three more times with methylene chloride. The combined organic layers were washed with a saturated salt solution, dried over anhydrous magnesium sulfate, and concentrated to an oil. The oil was slurried in warm diethyl ether, and cooled to ice temperature where crystallization occurred; the dialcohol was collected, recovering 40.11 g of a white solid. The proton NMR spectrum ($CDCl_3$) indicated a large singlet at 3.64 δ, and a small triplet centered at 2.75 δ with an area ratio of 18.7. There was a strong OH absorption in the infrared spectrum.

Compound 24

To 16.52 g of the dialcohol 23 was added 2.4 g of glutaric anhydride, and 3.1 mL triethylamine in 70 mL of dry tetrahydrofuran. The solution was heated at reflux for 20 hr and then concentrated to an oil using the rotovap. The oil was diluted with water, and 2 mL concentrated HCL was added, and then extracted three times with methylene chloride. The combined organic layers were dried over anhydrous magnesium sulfate and concentrated to a clear oil. The oil was triturated in warm diethyl ether, cooled to ice temperature, collecting 14.70 g of a white solid.

The preparations described above were modified as known to those skilled in the art in the preparation of the following compounds for which the preparation is not specifically described. Structures of the inventive and comparative compounds are provided in Table I.

TABLE I

| Cmpd. No. | Compound |
|---|---|
| 1[c] | $H-OC(CH_2)_3C(=O)-O(CH_2)_2S(CH_2)_2OC(=O)(CH_2)_3C(=O)-O-H$ |
| 2[c] | 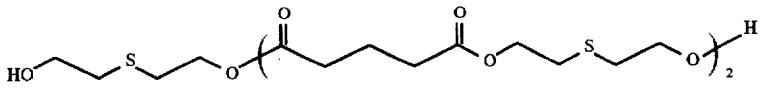 |
| 3[c] | $H-OC(CH_2)_3C(=O)\leftarrow O(CH_2)_2S(CH_2)_2OC(=O)(CH_2)_3C(=O)\rightarrow_3 O-H$ |
| 4[c] | 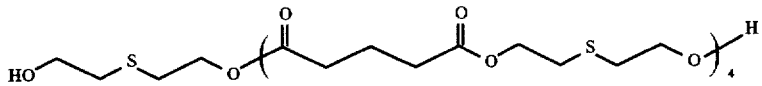 |
| 5[i] | $H-OC(CH_2)_3C(=O)\leftarrow O(CH_2)_2S(CH_2)_2OC(=O)(CH_2)_3C(=O)\rightarrow_5 O-H$ |
| 6[c] | 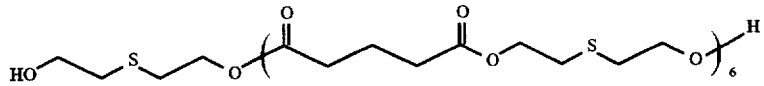 |
| 7[i] | $H-OC(CH_2)_3C(=O)\leftarrow O(CH_2)_2S(CH_2)_2OC(=O)(CH_2)_3C(=O)\rightarrow_7 O-H$ |
| 8[c] | $H(O(CH_2)_2S(CH_2)_2OC(=O)(CH_2)_3C(=O))_xOH$ |
| 9[c] | $H(O(CH_2)_2S(CH_2)_2OC(=O)(CH_2)_3C(=O))_xOCH_3$ |
| 10[i] | $HOC(=O)(CH_2)_3C(O(CH_2)_2S(CH_2)_2OC(=O)(CH_2)_3C(=O))_xOH$ |
| 11[c] | 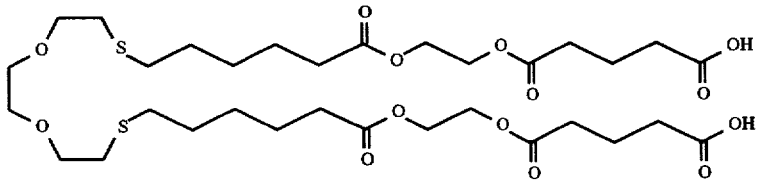 |
| 12[i] | 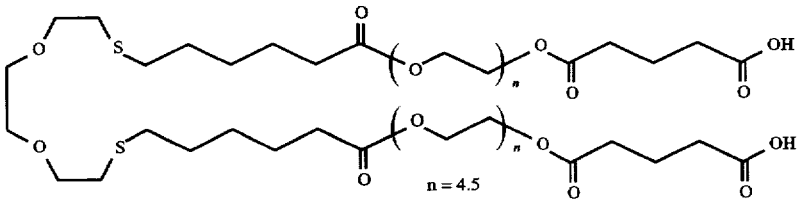 n = 4.5 |

TABLE I-continued
| Cmpd. No. | Compound |
|---|---|
| 13[j] | 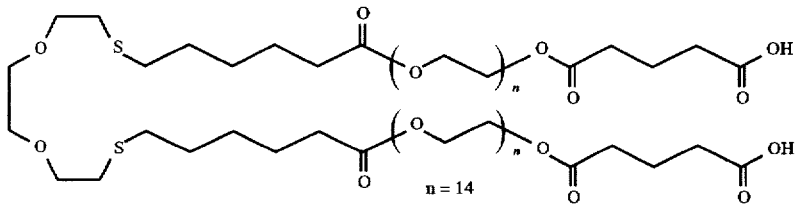 |
| 14[c] | 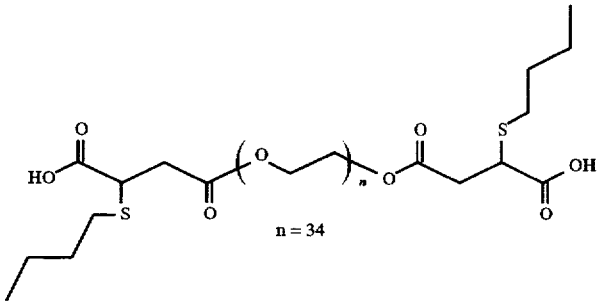 |
| 15[c] | 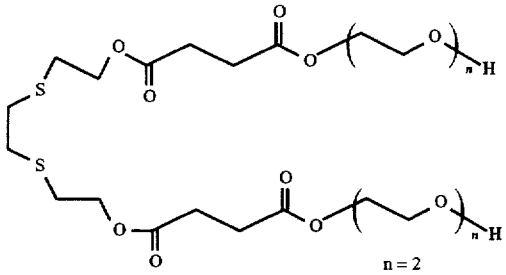 |
| 16[c] | 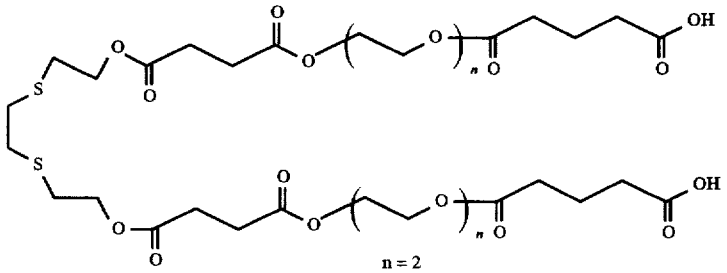 |
| 17[c] | 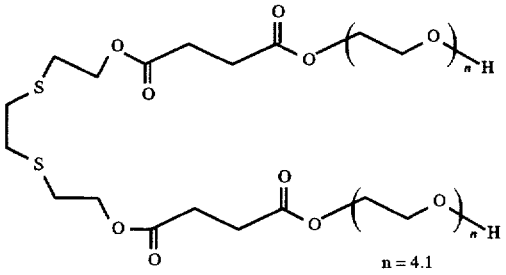 |

TABLE I-continued
| Cmpd. No. | Compound |
|---|---|
| 18[i] | 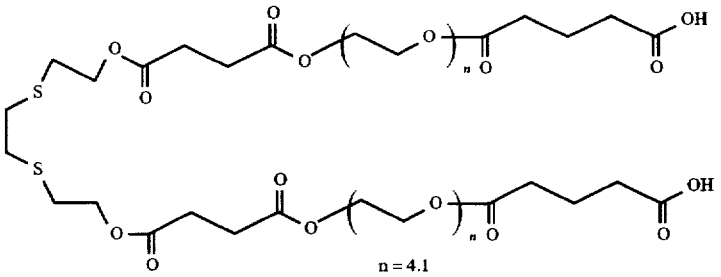 n = 4.1 |
| 19[c] | 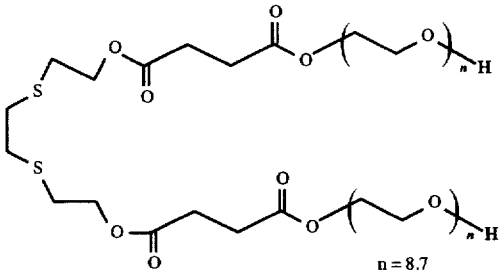 n = 8.7 |
| 20[i] | 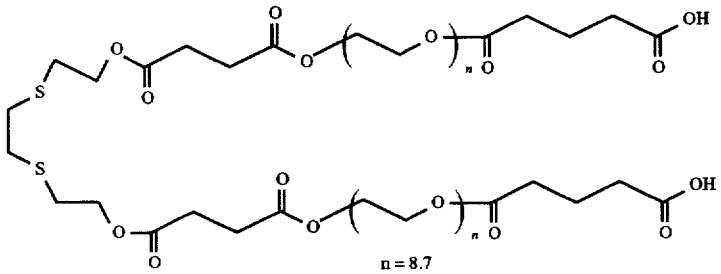 n = 8.7 |
| 21[c] | 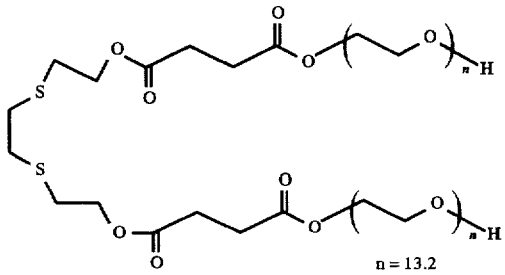 n = 13.2 |
| 22[i] | 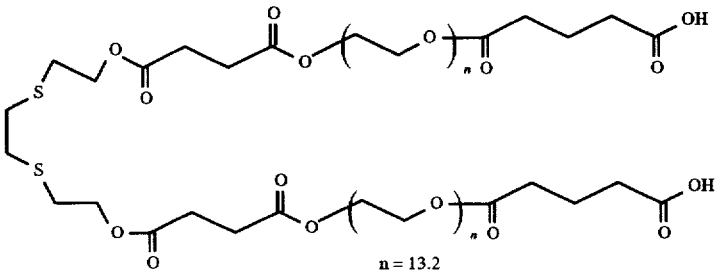 n = 13.2 |
| 23[c] | 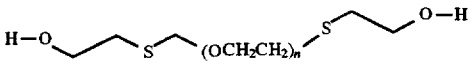 n = 34 |

TABLE I-continued

| Cmpd. No. | Compound |
|---|---|
| 24[i] | 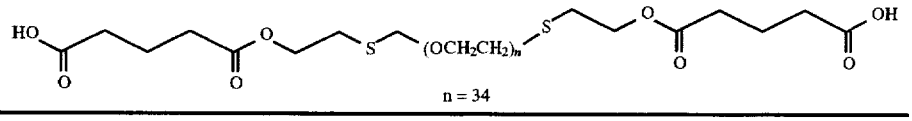 n = 34 |

[i]Inventive compounds used in Examples
[c]Comparison compounds

Example 1

Each layer having the composition set forth below was coated on a cellulose triacetate film support containing a subbing layer to prepare a multilayer color photographic light-sensitive material which was designated sample 101. The components utilized are shown as g/m$^2$ except for sensitizing dyes and the comparison compounds which are shown in molar amounts/mole of silver halide present in the same layer.

| Photographic Element 101 | |
|---|---|
| First Layer: Antihalation Layer | |
| Black Colloidal Silver | 0.43 (as silver) |
| Gelatin | 2.44 |
| Second Layer: Intermediate Layer | |
| Gelatin | 1.22 |
| Third Layer: Red Sensitive Layer | |
| Silver iodobromide emulsion | 1.08 (as silver) |
| RSD-3/RSD-4 | 0.00075 |
| Cyan Coupler C-2 | 1.29 |
| Dibutyl phthalate | 0.65 |
| Gelatin | 1.62 |
| Forth Layer: Intermediate Layer | |
| Competitor CP-1 | 0.21 |
| Gelatin | 0.43 |
| Fifth Layer: Green Sensitive Layer | |
| Silver iodobromide emulsion | 1.08 (as silver) |
| Sensitizing dye GSD-3 | 0.00075 |
| Sensitizing dye GSD-4 | 0.00025 |
| Magenta coupler M1 | 0.68 |
| Tritoyl phosphate | 0.34 |
| Gelatin | 3.19 |
| Sixth Layer: Protective Layer | |
| Gelatin | 3.19 |
| Bis(vinylsulfonylmethane) | 0.19 |

Samples 102 and 114 were prepared in the same manner as described above for Sample 101 except for the addition of the poly(thioether)s listed in Table I to the green sensitive fifth layer. The poly(thioether)s were dispersed as direct dispersions in gelatin and added at 654 mg of addenda/silver mole.

Each of the samples thus prepared was cut into a 35 mm width strip. The samples were exposed to a step exposure using white light. The samples were then processed in a color negative process using standard Kodak C-41 processing solutions. Dmin, speed, contrast, and Dmax were determined for both the light sensitive layers. Table II shows the photographic response for the green sensitive fifth layer. In Table II Samples 102–106 are an analogous series increasing in molecular weight. Compound 1 was prepared from a thiodiethanol capped with two glutaric acid groups. Compound 2 is Compound 1 capped with two thiodiethanol groups, etc. What is observed in this series is decreasing activity of the alcohol ended Compounds as molecular weight increases. The acid solubilized Compounds show increasing development acceleration activity, higher Dmin, speed, contrast and Dmax with increasing molecular weight. Compound 5, an inventive Compound, is the most active development accelerator in this series while Compound 6, which is prepared from Compound 5 by capping with thiodiethanol, is the least active of the alcohol molecules. Compound 5 is also more active than the polymeric samples in Table II, including inventive Compound 10.

Comparison Compound 8 is a polymer obtained by the co-polymerization of glutaric anhydride and thiodiethanol. Such polymers commonly have a statistical distribution of alcohol and carboxylic acid end groups. The total end group population of alcohol groups and the population of carboxylic acid end groups will usually be equal to each other if the molar amounts of starting materials are also equal. Sample 108 and 110 both use Compound 8 at different molecular weight distribution. Compound 9 was obtained by ester capping the free acid groups in Compound 8, two examples of which are shown in Samples 109 and 111. Compound 10 was obtained by acid capping the alcohol groups in Compound 8 to obtain an inventive example. The series Sample 108–109 and 110– 111 both illustrate how the removal of acid solubilization leads to less development acceleration as demonstrated by speed, contrast and Dmax loss. This effect was seen using two different molecular weight polymers, but was most apparent for the higher activity polymer used in Sample 108. The inventive Compound 10 in Sample 112 shows significantly higher development acceleration activity than its parent comparison Compound 8 shown in Sample 110. Similar trends are seen when comparing sample 113 to its acid capped inventive analog in Sample 114.

TABLE II

Example 1 Green Sensitive Layer Response

| Sample | Development Accelerator | | MW | Dmin | Relative Speed[c] | Contrast[d] | Dmax |
|---|---|---|---|---|---|---|---|
| 101 | None | (Check) | check | 0.18 | 2.88 | 0.68 | 1.53 |
| 102 | Cmpd 1 | (Comparison) | 160[a] | 0.17 | 2.87 | 0.68 | 1.53 |

TABLE II-continued

Example 1 Green Sensitive Layer Response

| Sample | Development Accelerator | | MW | Dmin | Relative Speed[c] | Contrast[d] | Dmax |
|---|---|---|---|---|---|---|---|
| 103 | Cmpd 2 | (Comparison) | 559[a] | 0.17 | 2.88 | 0.86 | 1.85 |
| 104 | Cmpd 3 | (Comparison) | 787[a] | 0.18 | 2.89 | 0.75 | 1.68 |
| 105 | Cmpd 4 | (Comparison) | 945[a] | 0.19 | 2.91 | 0.79 | 1.78 |
| 106 | Cmpd 5 | (Invention) | 1223[a] | 0.27 | 3.07 | 1.20 | 2.39 |
| 107 | Cmpd 6 | (Comparison) | 1432[a] | 0.19 | 2.92 | 0.73 | 1.66 |
| 108 | Cmpd 8 | (Comparison) | 5160[b] | 0.22 | 2.99 | 0.92 | 1.99 |
| 109 | Cmpd 9 | (Comparison) | 5290[b] | 0.19 | 2.95 | 0.74 | 1.74 |
| 110 | Cmpd 8 | (Comparison) | 6290[b] | 0.18 | 2.94 | 0.74 | 1.77 |
| 111 | Cmpd 9 | (Comparison) | 6230[b] | 0.18 | 2.91 | 0.71 | 1.61 |
| 112 | Cmpd 10 | (Invention) | 6420[b] | 0.22 | 2.99 | 0.85 | 1.97 |
| 113 | Cmpd 8 | (Comparison) | 6800[b] | .21 | 2.97 | .77 | 1.82 |
| 114 | Cmpd 10 | (Invention) | 6970[b] | .22 | 3.00 | .88 | 1.94 |

[a]Absolute molecular weight
[b]Polystyrene equivalent weight average molecular weight, $\overline{Pw}$, as determined by size exclusion chromatography
[c]Photographic speed in log E units at a green density of 0.5
[d]Photographic speed in log E units at a green density of 1.0

Example 2

Samples 201 to 214 were prepared in the same manner as described above. Each of the samples thus prepared was cut into a 35 mm width strip. The samples were exposed to a step exposure using white light. The samples were then processed using standard Kodak E-6 processing solutions and development conditions. Relative speed at two different speed points and Dmax was determined for the green sensitive fifth layer. Table III illustrates the photographic response of the green sensitive fifth layer. In a reversal format, development acceleration is seen by increases in speed and decreases in Dmax. In Table III Samples 202–206 are a molecular weight series of thioethers with alternating alcohol and acid end groups, as was discussed in Example 1. What is observed in this series is decreasing activity of the alcohol ended Compounds as molecular weight is increased. The acid solubilized Compounds show increasing development acceleration activity with increasing molecular weight. Compound 5, an inventive Compound, is the most active development accelerator in this series, while Compound 6, which is prepared from Compound 5 by capping with thiodiethanol, is the least active of the alcohol endgroup molecules. Compound 5 is also more active than the polymeric samples discussed later in the Table.

Comparison Compound 8 was discussed in Example 1. Samples 208 and 210 both use Compound 8 at different molecular weight distributions. Compound 9 was obtained by ester capping the free acid groups in Compound 8, two examples of which are show in Samples 209 and 211. Compound 10 was obtained by acid capping the alcohol groups in Compound 8 to obtain an inventive example. The series Samples 208–209 and 210–211 both illustrate how the removal of acid solubilization leads to less development acceleration as demonstrated by speed loss. This effect was seen using two different molecular weight parent polymers. The inventive Compound 10 in Sample 212 shows significantly higher development acceleration activity than its parent, comparison Compound 8, shows in Sample 210. Similar trends are seen comparing sample 213 to its acid capped inventive analog in sample 214.

TABLE III

Example 2 Green Sensitive Layer Response

| Sample | Development Accelerator | | MW | Relative Speed 1[c] | Relative Speed 2[d] | Dmax |
|---|---|---|---|---|---|---|
| 201 | None | (Check) | check | 1.70 | 2.05 | 2.09 |
| 202 | Cmpd 1 | (Comparison) | 160[a] | 1.70 | 2.05 | 2.08 |
| 203 | Cmpd 2 | (Comparison) | 559[a] | 1.98 | 2.23 | 2.00 |
| 204 | Cmpd 3 | (Comparison) | 787[a] | 1.86 | 2.17 | 1.99 |
| 205 | Cmpd 4 | (Comparison) | 945[a] | 1.90 | 2.22 | 1.93 |
| 206 | Cmpd 5 | (Invention) | 1223[a] | 2.29 | 2.50 | 1.76 |
| 207 | Cmpd 6 | (Comparison) | 1432[a] | 1.78 | 2.10 | 2.05 |
| 208 | Cmpd 8 | (Comparison) | 5160[b] | 1.97 | 2.29 | 1.89 |
| 209 | Cmpd 9 | (Comparison) | 5290[b] | 1.90 | 2.24 | 1.88 |
| 210 | Cmpd 8 | (Comparison) | 6290[b] | 1.87 | 2.20 | 2.05 |
| 211 | Cmpd 9 | (Comparison) | 6230[b] | 1.77 | 2.11 | 2.01 |
| 212 | Cmpd 10 | (Invention) | 6420[b] | 1.94 | 2.27 | 1.89 |
| 213 | Cmpd 8 | (Comparison) | 6800[b] | 1.85 | 2.19 | 1.95 |
| 214 | Cmpd 10 | (Invention) | 6970[b] | 1.94 | 2.28 | 1.87 |

[a]Absolute molecular weight
[b]Polystyrene equivalent weight average molecular weight, $\overline{Pw}$, as determined by size exclusion chromatography
[c]Photographic speed in log E units at a green density of 0.5
[d]Photographic speed in log E units at a green density of 1.0

Example 3

Sample 301 was prepared like Sample 101 in Example 1. Samples 302 to 308 were prepared in the same manner as described above for Sample 301 except for the addition of the poly(thioether)s listed in Table I to the green sensitive fifth layer. The poly(thioether)s were dispersed as direct dispersions in gelatin and added at the level indicated in mmol/silver mole. For polymeric materials the mmol level was parenthetically based on average molecular weight.

Each of the samples thus prepared was cut into a 35 mm width strip. The samples were exposed to a step exposure using white light. The samples were then processed in a color negative process using standard Kodak C-41 processing solutions. Dmin, speed, contrast, and Dmax were determined for both the green and red sensitive layers. Table IV provides the photographic response of the green sensitive fifth layer. Two molecular weight series are illustrated with different parent molecules. The first series, Samples 302–304, includes Compound 3 and Compound 5 discussed in Examples 1 and 2. This series had previously shown increased activity as molecular weight increased. Compound 7, having a further increase in molecular weight, is lower in development acceleration activity than Compound 5, illustrating a preferred molecular weight region for development acceleration activity, as indicated by fog, speed, contrast and Dmax increase. The second series, Samples 305–307, on a different parent molecule illustrate a similar trend. Activity increases as a function of molecular weight increase from Compound 11 to Compound 12, and then as molecular weight is further increased, activity decreases from Compound 12 to Compound 13. Compound 13, however, is still an active development accelerator particularly when compared to comparative Compound 14. Compound 13 and Compound 14 have similar molecular weights, both contain solubilizing groups and both materials have two thioether groups. The inventive sample has separation between the solubilizing group and the thioether group, a previously unrecognized and important characteristic for activity. At 10× the molar laydown, Compound 14, approaches the activity of Compound 13, but fails to match the activity of Compound 12, which has the preferred molecular weight, and falls very short of Compound 5, which has both preferred molecular weight and preferred structure.

TABLE IV

Example 3 Green Sensitive Layer Response

| Sample | Development Accelerator | | Level[a] | MW | Dmin | Speed[c] | Contrast[d] | Dmax |
|---|---|---|---|---|---|---|---|---|
| 301 | None | (Check) | check | check | 0.18 | 2.72 | 0.52 | 1.31 |
| 302 | Cmpd 3 | (Comparison) | 0.53 | 786 | 0.18 | 2.76 | 0.59 | 1.43 |
| 303 | Cmpd 5 | (Invention) | 0.53 | 1223 | 0.23 | 2.92 | 0.99 | 2.08 |
| 304 | Cmpd 7 | (Invention) | 0.53 | 1660 | 0.21 | 2.88 | 0.90 | 1.89 |
| 305 | Cmpd 11 | (Comparison) | 0.53 | 727[b] | 0.19 | 2.75 | 0.56 | 1.39 |
| 306 | Cmpd 12 | (Invention) | 0.53 | 1003[b] | 0.25 | 2.86 | 0.83 | 1.84 |
| 307 | Cmpd 13 | (Invention) | 0.53 | 1803[b] | 0.21 | 2.82 | 0.72 | 1.62 |
| 308 | Cmpd 14 | (Comparison) | 0.53 | 1892[b] | 0.18 | 2.75 | 0.54 | 1.40 |
| 309 | Cmpd 14 | (Comparison) | 5.30 | 1892[b] | 0.19 | 2.79 | 0.73 | 1.70 |

[a]mmole compound/mole silver in the layer
[b]parenthetically based on average molecular weight
[c]Photographic speed in log E units at a green density of 0.2 above Dmin
[d]Best Fit Contrast

Example 4

Sample 401 was prepared like Sample 101 in Example 1. Samples 402 to 413 were prepared in the same manner as described above for Sample 301 except for the addition of the poly(thioether)s listed in Table I to the green sensitive fifth layer. The poly(thioether)s were dispersed as direct dispersions in gelatin and added at level of 0.53 mmol/silver mole. For polymeric materials the mmol level was parenthetically based on average molecular weight.

Each of the samples thus prepared was cut into a 35 mm width strip. The samples were exposed to a step exposure using white light. The samples were then processed in a color negative process using standard Kodak C41 processing solutions. Dmin, speed, contrast, Dmax and were determined for both the green and red sensitive layers. Table V shows the photographic response of the green sensitive fifth layer. Samples 402–409 compare a molecular weight series of alternating alcohol-capped poly(thioethers), (Compound 15, 17, 19, and 21) and carboxylic acid-capped derivatives (Compound 16, 18, 20, and 22). The alcohol-capped poly (thioethers) had a Dmin, speed, contrast and Dmax only slightly higher than control without developer accelerator, Sample 401. The carboxylic acid-capped compounds exhibited increased activity as molecular weight increased, this was most evident when comparing inventive Compound 20 and 22 to comparative Compound 19 and 21.

In the second series, Samples 410 and 411, a poly (alkylene oxide) is capped with thiodiethanol to create comparison Compound 23. This alcohol ended poly (thioether) exhibits only slight evidence of development acceleration. Compound 23 was acid capped with glutaric acid to create inventive Compound 24. Addition of carboxylic acid solubilization to Compound 24 leads to a boost in activity as can be seen by increased fog, speed, contrast and Dmax. The importance of spacing between the thioether and the acid functional group (solubilization group) is again illustrated by the branch comparison Compound 14, which is much less active as a development accelerator compared to the similar molecular weight inventive Compound 24. Compound 5, shown in Sample 413, which contains the most preferred molecular weight and structure continues to offer the largest boost in development acceleration.

TABLE V

Example 4 Green Sensitive Layer Response

| Sample | Development Accelerator | | MW[a] | Dmin | Relative Speed[b] | Contrast[c] | Dmax |
|---|---|---|---|---|---|---|---|
| 401 | None | (Check) | check | 0.18 | 2.72 | 0.46 | 1.25 |
| 402 | Cmpd 15 | (Comparison) | 559 | 0.19 | 2.78 | 0.50 | 1.34 |
| 403 | Cmpd 16 | (Comparison) | 787 | 0.19 | 2.78 | 0.47 | 1.27 |
| 404 | Cmpd 17 | (Comparison) | 750 | 0.24 | 2.76 | 0.50 | 1.39 |
| 405 | Cmpd 18 | (Invention) | 970 | 0.20 | 2.80 | 0.55 | 1.33 |
| 406 | Cmpd 19 | (Comparison) | 1150 | 0.18 | 2.77 | 0.49 | 1.30 |
| 407 | Cmpd 20 | (Invention) | 1370 | 0.22 | 2.86 | 0.64 | 1.61 |
| 408 | Cmpd 21 | (Comparison) | 1550 | 0.19 | 2.78 | 0.49 | 1.34 |
| 409 | Cmpd 22 | (Invention) | 1770 | 0.23 | 2.88 | 0.68 | 1.65 |
| 410 | Cmpd 23 | (Comparison) | 1652 | 0.19 | 2.75 | 0.46 | 1.28 |
| 411 | Cmpd 24 | (Invention) | 1880 | 0.21 | 2.84 | 0.63 | 1.54 |
| 412 | Cmpd 14 | (Comparison) | 1892 | 0.18 | 2.76 | 0.49 | 1.30 |
| 413 | Cmpd 5 | (Invention) | 1223 | 0.23 | 2.90 | 0.92 | 1.98 |

[a]Molecular weight parenthetically based on average molecular weight
[b]Photographic speed in log E units at a green density of 0.2 above Dmin
[c]Best Fit Contrast Structures used in Example 1–4:

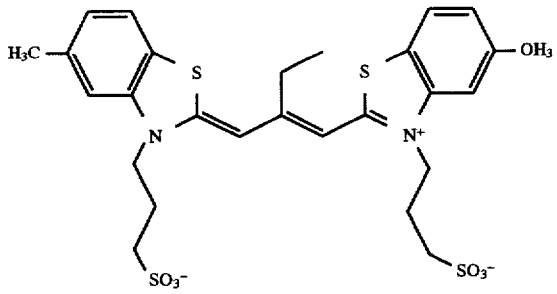

RSD-3

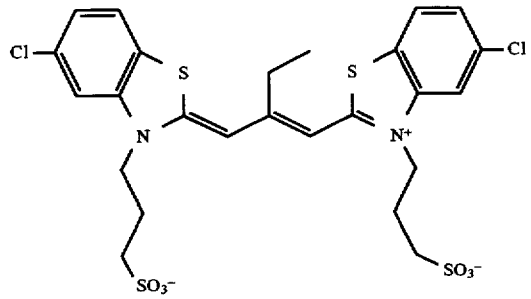

RSD-4

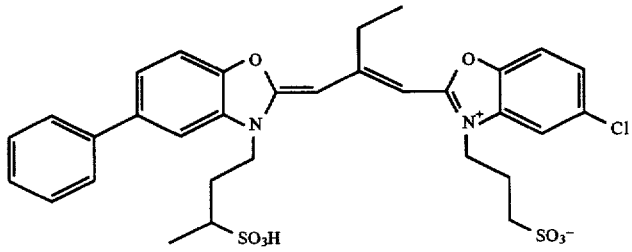

GSD-3

-continued

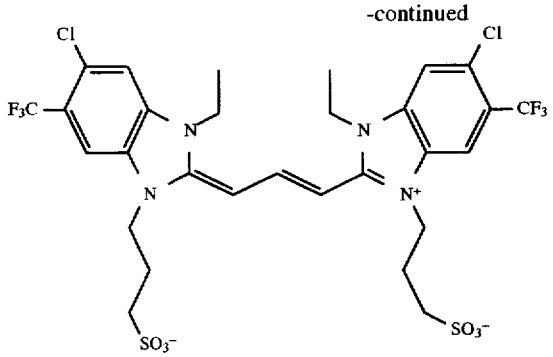

GSD-4

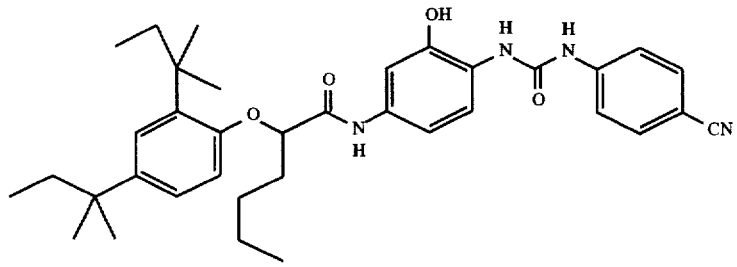

C-2

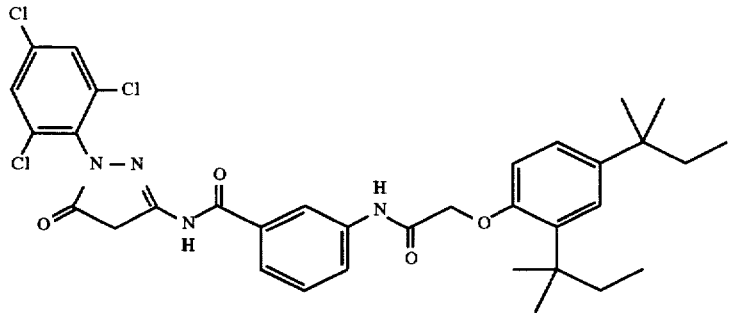

M-1

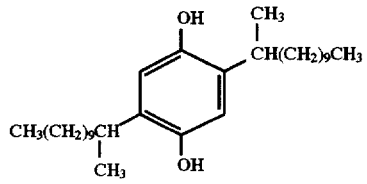

CP-1:

Example 5

In a prophetic example for a reversal format, the inventive thioether with acidic functional endgroups may be coated with an appropriately sensitized silver iodobromide emulsion in a multilayer reversal film that was prepared as follows. Each layer having the composition set forth below was coated on a cellulose triacetate support provided with a subbing layer to prepare a multilayer color photographic light-sensitive material. In the composition of the layers, the coating amounts are shown as grams per square meter except for sensitizing dyes, which are shown as the molar amount per mole of silver halide present in the same layer. Laydowns of silver halide are reported relative to silver. Emulsion sizes as determined by the disc centrifuge method are reported in diameter×thickness in microns.

| | |
|---|---|
| First layer: Antihalation Layer | |
| Black Colloidal Silver | 0.43 |
| Gelatin | 2.44 |

-continued

| | |
|---|---|
| Second layer: Intermediate Layer | |
| Gelatin | 1.22 |
| Third Layer: Slow Red Sensitive Layer | |
| AgIBr tabular emulsion (4% I, 0.6 × 0.1) | 0.62 |
| RSD-1/RSD-2 | 0.00142 |
| C-1 | 0.20 |
| Dibutyl phthalate | 0.10 |
| ST-1 | 0.06 |
| Gelatin | 0.86 |
| Fourth Layer: Fast Red Sensitive Layer | |
| AgIBr tabular emulsion (4% I, 0.97 × 0.13) | 0.65 |
| RSD-1/RSD-2 | 0.00105 |
| C-1 | 1.00 |
| Dibutyl phthalate | 0.50 |
| Gelatin | 1.83 |
| Fifth Layer: Intermediate Layer | |
| DYE-1 | 0.07 |
| ST-1 | 0.12 |
| Gelatin | 1.22 |

-continued

| | |
|---|---|
| **Sixth Layer: Slow Green Sensitive Layer** | |
| AgIBr emulsion (3.3% I, 0.15 cubic + 4%. I, 0.7 × 0.1 tabular) | 0.70 |
| GSD-1/GSD-2 | 0.002 |
| M-1 | 0.07 |
| M-2 | 0.15 |
| Tritoyl phosphate | 0.11 |
| Gelatin | 0.83 |
| **Seventh Layer: Fast Green Sensitive Layer** | |
| AgIBr tabular emulsion (4% I, 0.97 × 0.13) | 0.50 |
| GSD-1/GSD-2 | 0.001 |
| M-1 | 0.32 |
| M-2 | 0.74 |
| Tritoyl phosphate | 0.52 |
| Gelatin | 1.67 |
| **Eighth Layer: Interlayer Layer** | |
| Gelatin | 2.15 |
| **Ninth Layer: Yellow Filter Layer** | |
| Carey Lea Silver | 0.002 |
| DYE-2 | 0.17 |
| ST-1 | 0.08 |
| Gelatin | 0.61 |

-continued

| | |
|---|---|
| **Tenth Layer: Slow Blue Sensitive Layer** | |
| AgIBr tabular emulsion (3% I, 1.1 × 0.12) | 0.28 |
| BSD-1 | 0.00108 |
| Y-1 | 0.66 |
| Dibutyl phthalate | 0.22 |
| Gelatin | 1.00 |
| **Eleventh Layer: Fast Blue Sensitive Layer** | |
| AgIBr tabular emulsion (3% I, 1.7 × 0.1) | 0.78 |
| BSD-1 | 0.0016 |
| Y-1 | 1.68 |
| Dibutyl phthalate | 0.56 |
| Gelatin | 2.47 |
| **Twelfth Layer: First Protective Layer** | |
| UV-1 | 0.06 |
| UV-2 | 0.32 |
| UV-3 | 0.09 |
| ST-1 | 0.06 |
| Gelatin | 1.40 |
| **Thirteenth Layer: Second Protective Layer** | |
| Fine grain AgBr emulsion | 0.12 |
| Matte | 0.02 |
| Bis(vinylsulfonylmethane) | 0.26 |
| Gelatin | 0.97 |

Structures used in Example 5

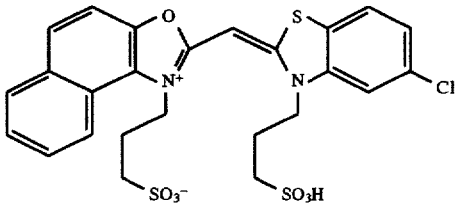

BSD-1

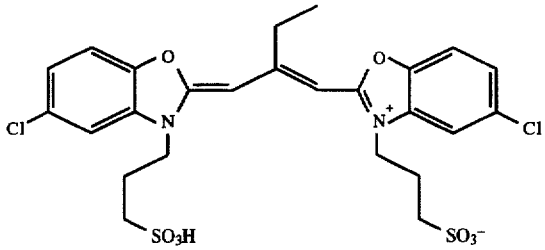

GSD-1

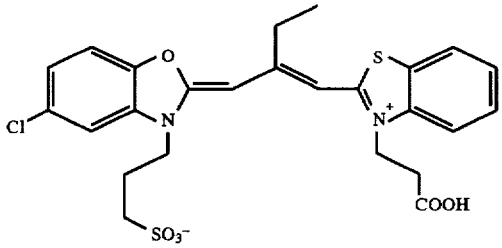

GSD-2

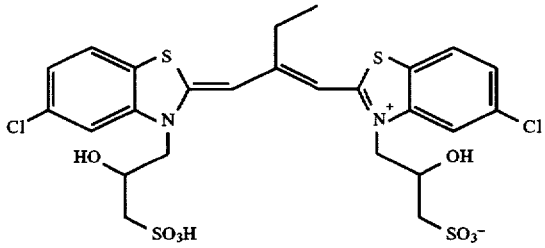

RSD-1

-continued
RSD-2
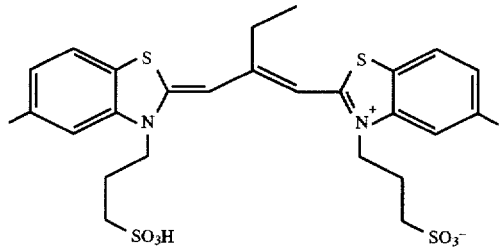
UV-1
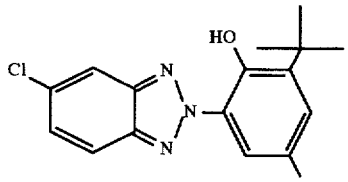
UV-2
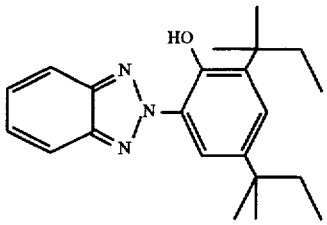
UV-3
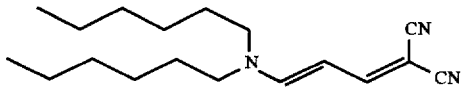
DYE-1
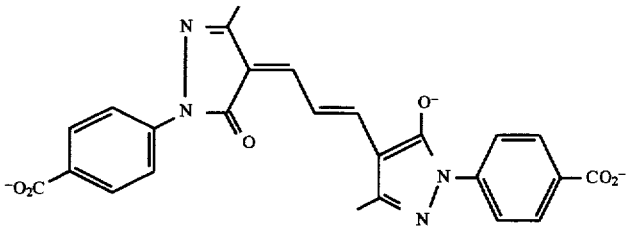
DYE-2
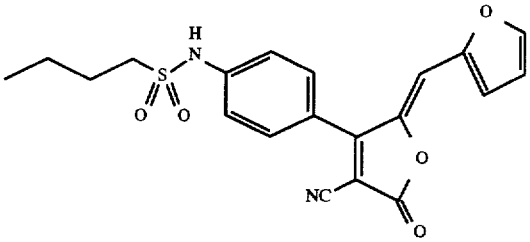
Y-1
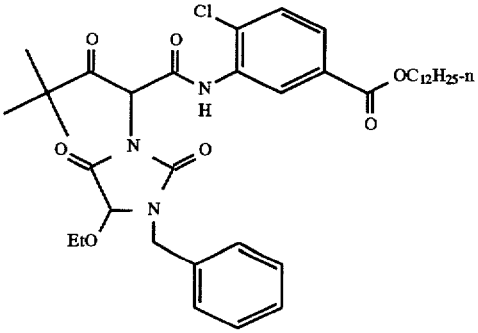

-continued

M-1

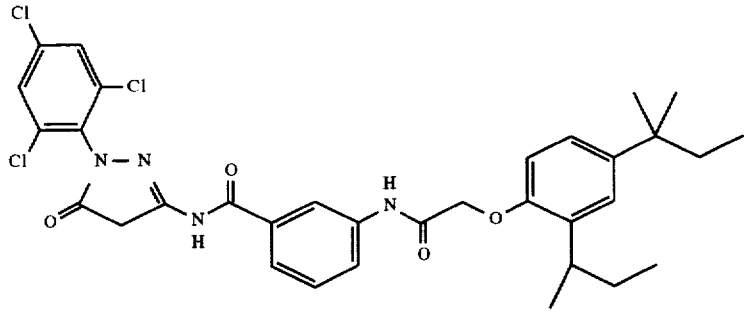

M-2

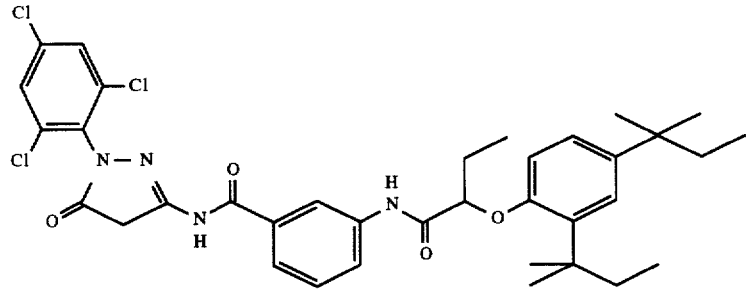

C-1

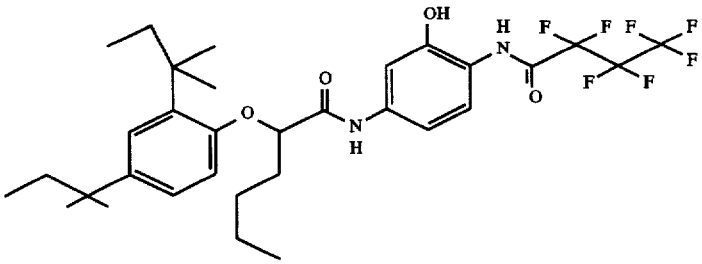

ST-1

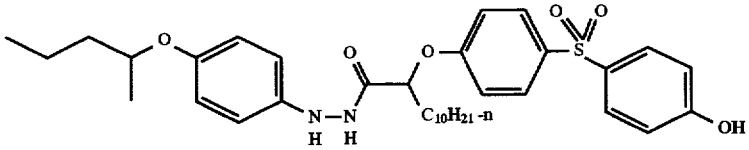

CP-1:

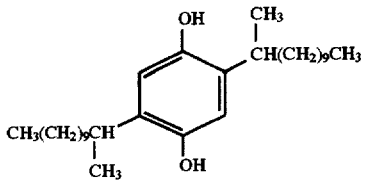

Example 6

In another prophetic example for a reversal format, the inventive thioether with acidic functional endgroups may be coated with appropriately sensitized silver iodobromide emulsions on a support bearing the following layers from top to bottom:

(1) one or more overcoat layers;

(2) a nonsensitized silver halide containing layer;

(3) a triple-coat yellow layer pack with a fast yellow layer containing

"Coupler 1": Benzoic acid, 4-(1-(((2-chloro-5-(dodecylsulfonyl)amino)phenyl)amino)carbonyl)-3,3-dimethyl-2-oxobutoxy)-,1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-(2-(2,4-bis(1,1-dimethylpropyl)phenoxy)-1-oxobutyl)amino)-N-(2,4,6-trichlorophenyl)-1H-pyrazol-3-yl; and "Coupler 5": Benzamide, 3-(((2,4-bis(1,1-dimethylpropyl)phenoxy)-acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3- hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)-phenoxy)-N-(4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

Example 7

In a prophetic example for a negative format, an inventive thioether with acidic functional endgroups may be coated with appropriately sensitized silver iodobromide emulsion in a multilayer photographic negative element produced by coating the following layers on a cellulose triacetate film support (coverages are in grams per meter squared, emulsion sizes as determined by the disc centrifuge method are reported in Diameter×Thickness in microns).

Layer 1 (Antihalation layer): black colloidal silver sol at 0.151; gelatin at 2.44; UV-1 at 0.075; UV-2 at 0.075; DYE-3 at 0.042; DYE-4 at 0.088; DYE-5 at 0.020; DYE-6 at 0.008 and STAB-1 at 0.161.

Layer 2 (Slow cyan layer): a blend of two silver iodobromide emulsions sensitized with a 1/9 mixture of RSD-3/RSD-4: (i) a small tabular emulsion (1.1×0.09, 4.1 mol % I) at 0.430 and (ii) a very small tabular grain emulsion (0.5×0.08, 1.3 mol % I) at 0.492; gelatin at 1.78; cyan dye-forming coupler C-2 at 0.538; bleach accelerator releasing coupler BARC-1 at 0.038; masking coupler MC-1 at 0.027.

Layer 3 (Mid cyan layer): a red sensitized (same as above) silver iodobromide emulsion (1.3×0.12, 4.1 mol % I) at 0.699; gelatin at 1.79; C-2 at 0.204; D-1 at 0.010; MC-1 at 0.022.

Layer 4 (Fast cyan layer): a red-sensitized (same as above) tabular silver iodobromide emulsion (2.9×0.13, 4.1 mol % I) at 1.076; C-2 at 0.072; D-1 at 0.019; D-2 at 0.048; MC-1 at 0.032; gelatin at 1.42.

Layer 5 (Interlayer): gelatin at 1.29.

Layer 6 (Slow magenta layer): a blend of two silver iodobromide emulsions sensitized with a 6/1 mixture of GSD-3/GSD-4: (i) 1.0×0.09, 4.1 mol % iodide at 0.308 and (ii) 0.5×0.08, 1.3% mol % I at 0.584; magenta dye forming coupler M-3 at 0.269; masking coupler MC-2 at 0.064; stabilizer STAB-2 at 0.054; gelatin at 1.72.

Layer 7 (Mid magenta layer): a green sensitized (as above) silver iodobromide emulsion: 1.3×0.12, 4.1 mol % iodide at 0.968; M-3 at 0.071; MC-2 at 0.064; D-3 at 0.024; stabilizer STAB-2 at 0.014; gelatin at 1.37.

Layer 8 (Fast magenta layer): a green sensitized (as above) tabular silver iodobromide (2.3×0.13, 4.1 mol % I) emulsion at 0.968; gelatin at 1.275; Coupler M-3 at 0.060; MC-2 at 0.054; D-4 at 0.0011; D-5 at 0.0011 and stabilizer STAB-2 at 0.012.

Layer 9 (Yellow filter layer): AD-1 at 0.108 and gelatin at 1.29.

Layer 10 (Slow yellow layer): a blend of three tabular silver iodobromide emulsions sensitized with sensitizing dye BSD-2: (i) 0.5×0.08, 1.3 mol % I at 0.295 (ii) 1.0×0.25, 6 mol % I at 0.50 and (iii) 0.81×0.087, 4.5 mol % I at 0.215; gelatin at 2.51; yellow dye forming couplers Y-1 at 0.725 and Y-2 at 0.289; D-6 at 0.064; C-1 at 0.027 and BARC-1 at 0.003.

Layer 11 (Fast yellow layer): a blend of two blue sensitized (as above) silver iodobromide emulsions: (i) a large tabular emulsion, 3.3×0.14, 4.1 mol % I at 0.227 and (ii) a 3-D emulsion, 1.1×0.4.9 mol % I at 0.656; Y-1 at 0.725; Y-2 at 0.289; D-6 at 0.029; C-1 at 0.048; BARC-1 at 0.007 and gelatin at 2.57.

Layer 12 (UV filter layer): gelatin at 0.699; silver bromide Lippman emulsion at 0.215; UV-1 at 0.011 and UV-2 at 0.011.

Layer 13 (Protective overcoat): gelatin at 0.882.

Hardener (bis(vinylsulfonyl)methane hardener at 1.75% of total gelatin weight), antifoggants (including 4-hydroxy-6-methyl-1,3,3a,7-tetraazaindene), surfactants, coating aids, emulsion addenda, sequestrants, lubricants, matte and tinting dyes were added to the appropriate layers as is common in the art.

Structures Example 7

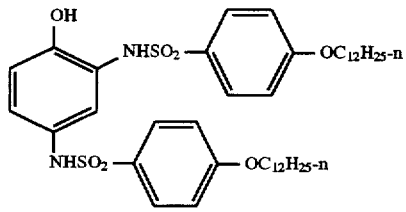

STAB-1

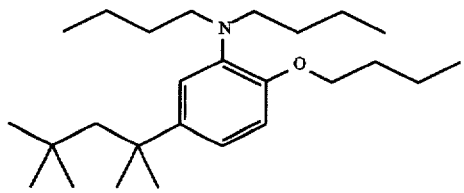

STAB-2

-continued
DYE-3
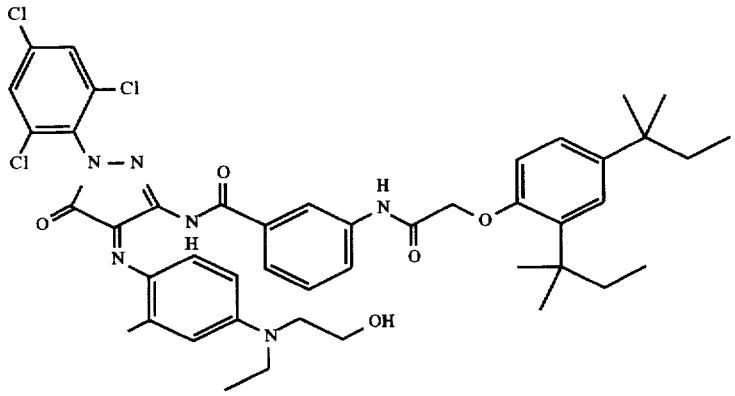
DYE-4
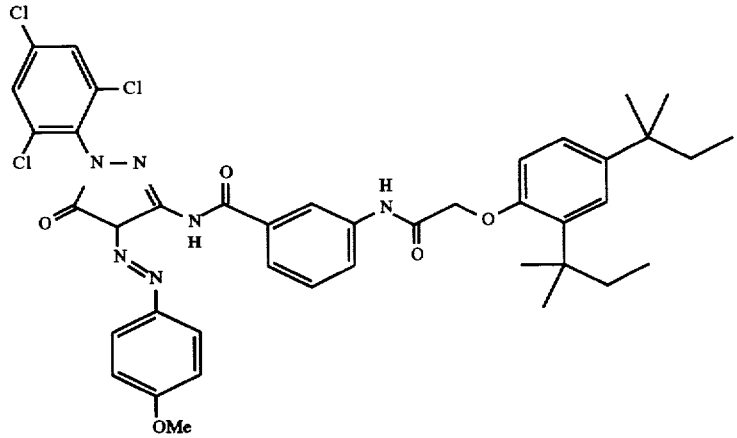
DYE-5
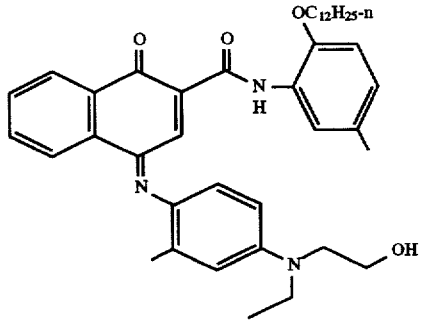
DYE-6
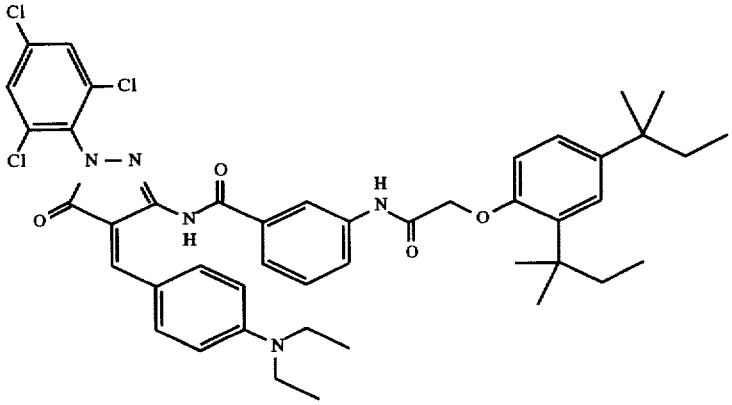

-continued
D-1
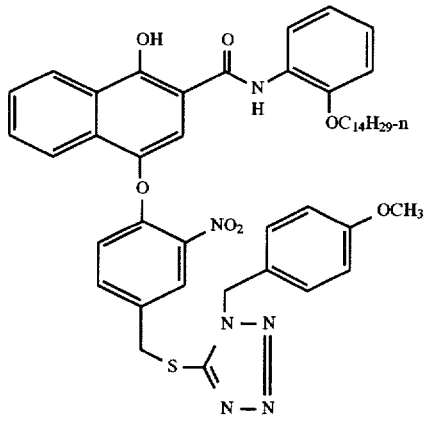
D-2
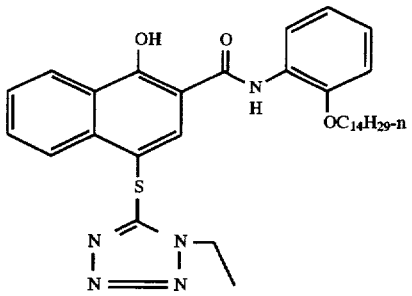
D-3
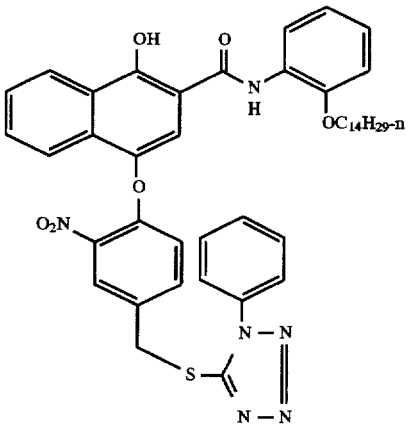
D-4
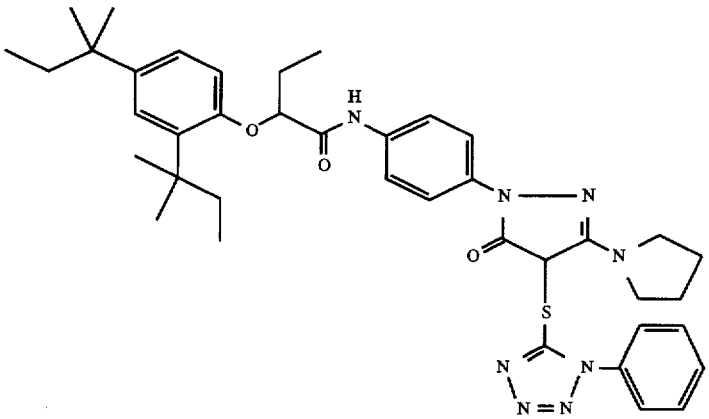

-continued
D-5
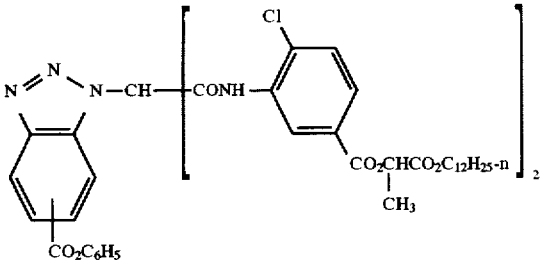
D-6
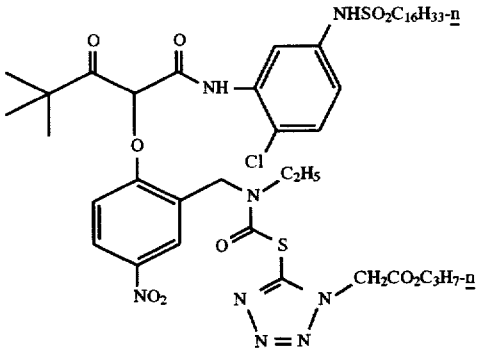
C-2
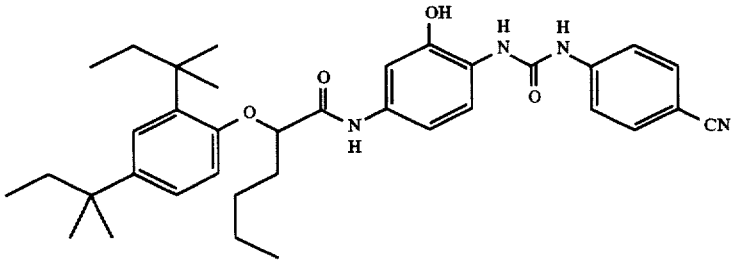
M-3
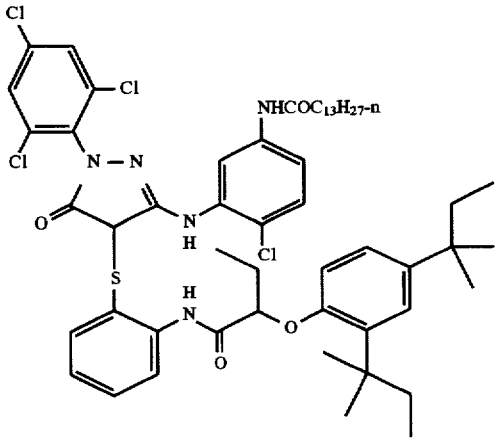
Y-1
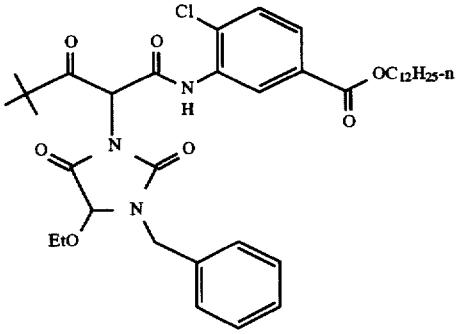

-continued
Y-2
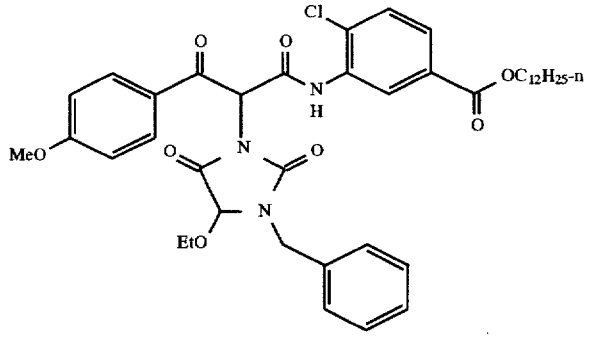
BARC-1
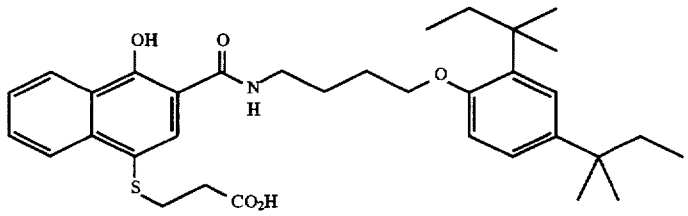
MC-1
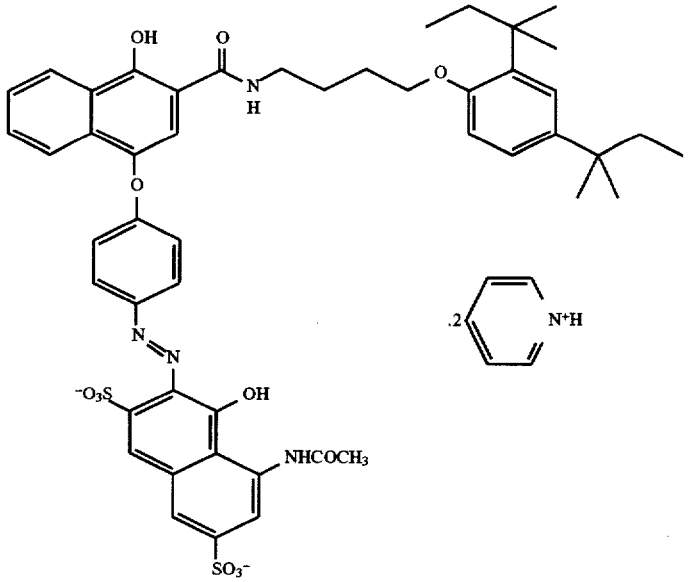
MC-2
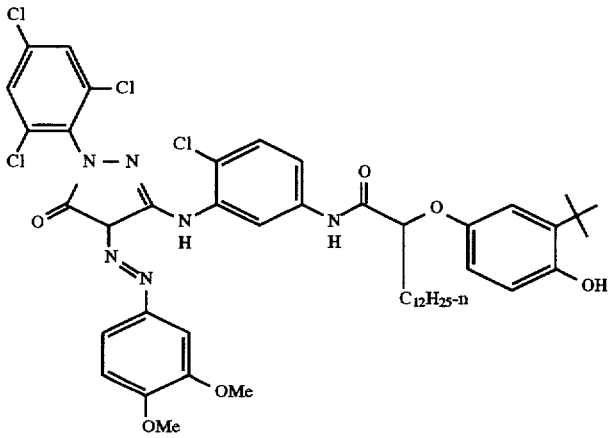

-continued
AD-1
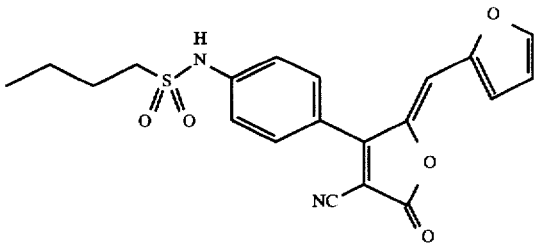
UV-3
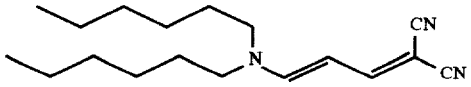
UV-4
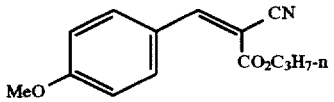
RSD-3
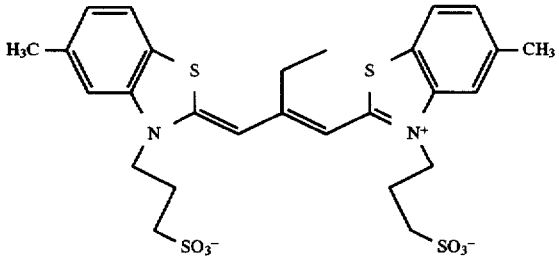
RSD-4
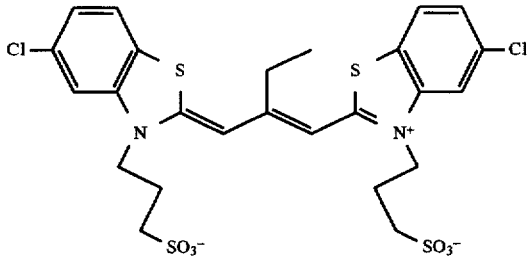
GSD-3
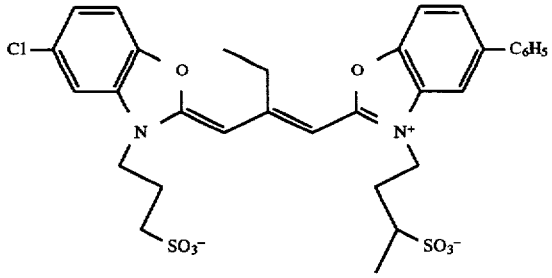
GSD-4
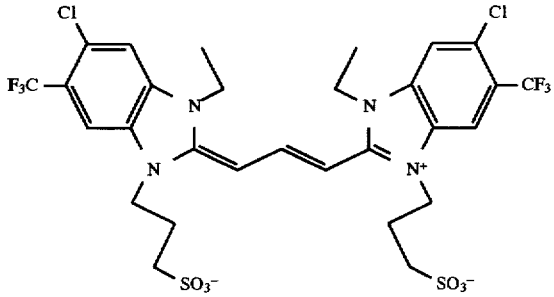

-continued

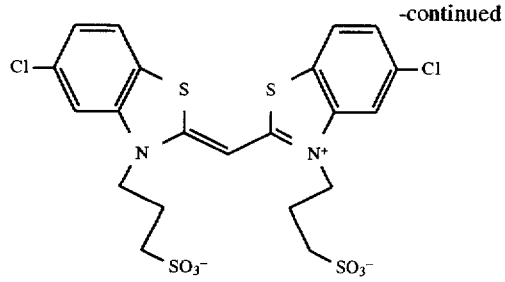

BSD-2

Example 8

In a another example for a color negative element, an inventive thioether with acidic functional endgroups may be coated with appropriately sensitized silver iodobromide emulsions on a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]-acetyl]amino]-5-[(2,2,3,3,4,4,4-heptafluoro-1-oxobutyl)amino]-4-hydroxyphenoxy]-2,3-dihydroxy-6-[(propylamino) carbonyl]phenyl]-thio]-1,3,4-thiadiazol-2yl]thio]-, methyl ester and "Coupler 3": 1-((dodecyloxy) carbonyl) ethyl(3-chloro-4-((3-(2-chloro-4-((1-tridecanoylethxy)carbonyl)anilino)-3-oxo-2((4)(5)(6)-(phenoxycarbonyl)-1H-benzotriazol-1-yl)propanoyl) amino))-benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-dihydro-5'-oxo-1'-(2,4,6-trichlorophenyl)(1,4'-bi-1H-pyrazol)-3'-yl)-, "Coupler 6": Carbamic acid, (6-(((3-(dodecyloxy)propyl)amino) carbonyl)- 5-hydroxy-1-naphthalenyl)-, 2-methylpropyl ester, "Coupler 7": Acetic acid, ((2-((3-(((3-(dodecyloxy)propyl)amino) carbonyl)-4-hydroxy-8-(((2-methyl-propoxy)carbonyl)amino)-1-naphthalenyl)oxy)ethyl)thio)-, and "Coupler 8": Benzamide, 3-((2-(2,4-bis(1,1-dimethylpropyl)-phenoxy)-1-oxobutyl)amino)-N-(4,5-dihydro-4-((4-methoxyphenyl)-azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-3-yl)amino) phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)-phenoxy)propyl)amino) -carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

The invention has been described in detail with particular reference to certain preferred embodiments thereof, but it will be understood that variations and modifications can be effected within the spirit and scope of the invention.

What is claimed is:

1. A silver halide color photographic element comprising a support, a silver halide emulsion and poly(thioether)s wherein greater than 50 percent of the poly(thioether)s have acidic functional end groups with an aqueous pKa≦10, or end groups which will react to form acidic functional end groups with an aqueous pKa≦10 during development, on both termini and wherein the poly(thioether)s have a molecular weight greater than 800.

2. The silver halide photographic element of claim 1 wherein greater than 95 percent of the poly(thioether)s have acidic functional end groups with an aqueous pKa≦10, or end groups which will react to form acidic functional end groups with an aqueous pKa≦10 during development, on both termini.

3. The silver halide photographic element of claim 1 wherein the poly(thioether)s have a molecular weight ranging substantially between 800 and 16000 AMU.

4. The silver halide photographic element of claim 3 wherein the poly(thioether)s have a molecular weight ranging substantially between 1000 and 7000 AMU.

5. A silver halide color photographic element comprising a support, a silver halide emulsion and poly(thioether)s wherein greater than 50 percent of the poly(thioether)s are represented by Formula I $$A—(L_i—X_i)_n—L—A' \qquad \text{I}$$

wherein

A and A' are independently acidic functional groups;

L and $L_i$ are independently divalent organic linking groups;

$X_i$ is independently non-metallic heteroatoms, with the proviso that at least one Xi must be a sulfur;

n is one to 300; and wherein the poly(thioether)s have a molecular weight greater than 800.

6. The silver halide photographic element of claim 5 wherein greater than 95 percent of the poly(thioether)s are represented by Formula I.

7. The silver halide photographic element of claim 5 wherein the poly(thioether)s have a molecular weight ranging substantially between 800 and 16000 AMU.

8. The silver halide photographic element of claim 7 wherein the poly(thioether)s have a molecular weight ranging substantially between 1000 and 7000 AMU.

9. The silver halide photographic element of claim 5 wherein A and A' are carboxylic acid, carboxylate salt, or sulfonic acid.

10. The silver halide photographic element of claim 5 wherein L and $L_i$, are independently substituted or unsubstituted alkylene, alkenyl, arylene, aralkylene or heteroarylene groups.

11. The silver halide photographic element of claim 5 wherein $X_i$ is independently —O—, —S—, —SO—, —$SO_2$—, or —$NR_1$—, wherein $R_1$ is a carboxyl, sulfonyl, acyl, uriedo, or substituted or unsubstituted alkyl, alkenyl, aryl, aralkyl or heteroaryl group.

12. The silver halide photographic element of claim 5 wherein greater than 95 percent of the poly(thioether)s are represented by Formula I; the poly(thioether)s have a molecular weight ranging substantially between 800 and 16000 AMU; A and A' are carboxylic acid, a carboxylate salt, or sulfonic acid; and X and $X_i$ are independently —O—, —S—, —SO—, —$SO_2$—, or —$NR_1$— wherein $R_1$ is a carboxyl, sulfonyl, uriedo, acyl or a substituted or unsubstituted alkyl, alkenyl, aryl, aralkyl or heteroaryl group.

13. A silver halide color photographic element comprising a support, a silver halide emulsion and poly(thioether)s wherein greater than 50 percent of the poly(thioether)s are represented by compounds having the formulae $$H-OC(CH_2)_3\underset{\underset{O}{\|}}{C}\left(O(CH_2)_2S(CH_2)_2O\underset{\underset{O}{\|}}{C}(CH_2)_3\underset{\underset{O}{\|}}{C}\right)_n O-H$$

wherein n is 4 to 7.

14. The silver halide photographic element of claim 13 wherein greater than 95 percent of the poly(thioether)s are represented by said formulae.

* * * * *